United States Patent [19]

Frank

[11] Patent Number: 5,036,206

[45] Date of Patent: Jul. 30, 1991

[54] COMBINED LASER POSITION DETECTOR, INFRARED EMISSIVITY TARGET AND TV TARGET

[75] Inventor: Jack D. Frank, Long Beach, Calif.

[73] Assignee: Hughes Aircraft Company, Los Angeles, Calif.

[21] Appl. No.: 479,024

[22] Filed: Feb. 12, 1990

[51] Int. Cl.[5] ..... G01B 11/26; F21K 2/00

[52] U.S. Cl. ..... 250/467.1; 250/341

[58] Field of Search ..... 250/330, 467.1, 341, 250/342; 356/138, 152, 153

[56] References Cited

U.S. PATENT DOCUMENTS

| | | | |
|---|---|---|---|
| 4,015,906 | 4/1977 | Sharon | 356/138 |
| 4,139,769 | 2/1979 | McCrum et al. | 250/341 |
| 4,168,429 | 9/1979 | Lough | 250/330 |
| 4,422,758 | 12/1983 | Godfrey et al. | 356/152 |
| 4,649,274 | 3/1987 | Hartmann | 250/341 |
| 4,743,765 | 5/1988 | Ekstrand | 250/467.1 |

*Primary Examiner*—Constantine Hannaher
*Assistant Examiner*—Edward J. Glick
*Attorney, Agent, or Firm*—Michael W. Sales; Wanda K. Denson-Low

[57] ABSTRACT

A combined laser position detector, infrared emissivity target and television target includes a light-transparent substrate having a TV target on one side and an infrared target on a second side, with the two targets in registration with one another. Alternatively, the TV and IR target can be on the same side. The substrate is affixed to a housing that includes light-emitting sources behind the targets positioned to direct emitted light through the targets and also includes a recess for receiving a laser position detector with an opening behind the targets to permit light to pass through the targets and to impinge upon the surface of the detector.

6 Claims, 2 Drawing Sheets

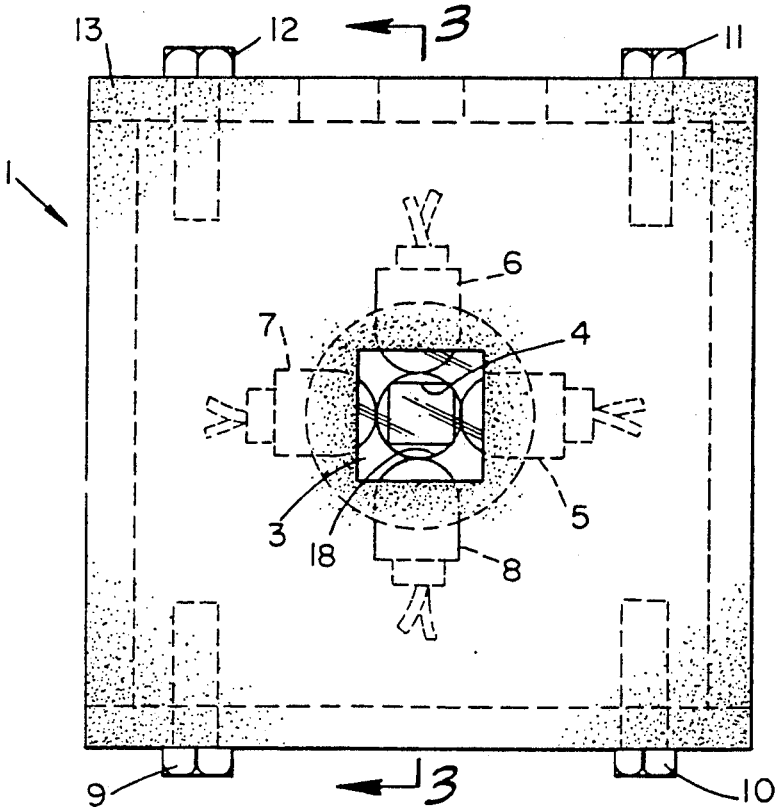
FIG. 1
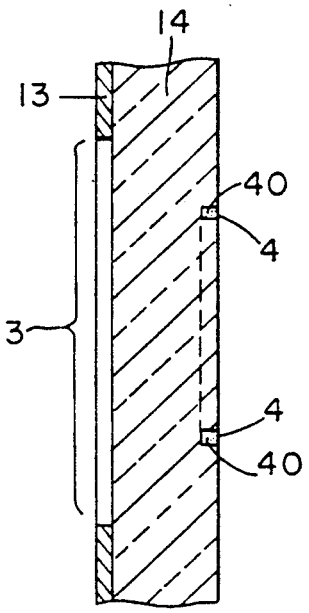
FIG. 4
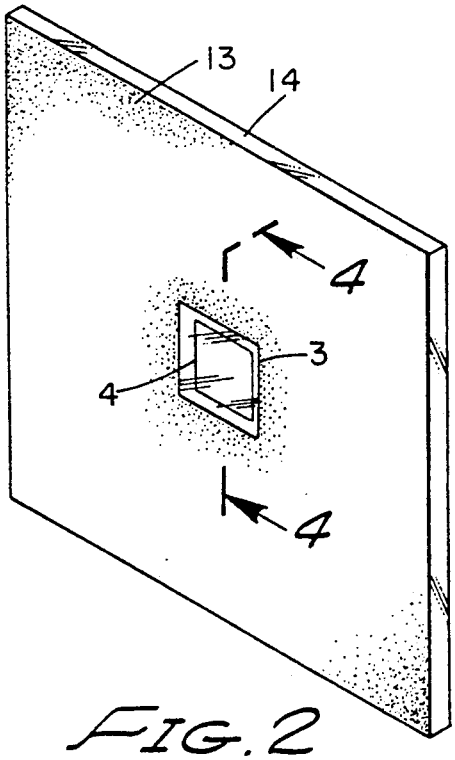
FIG. 2
FIG. 3
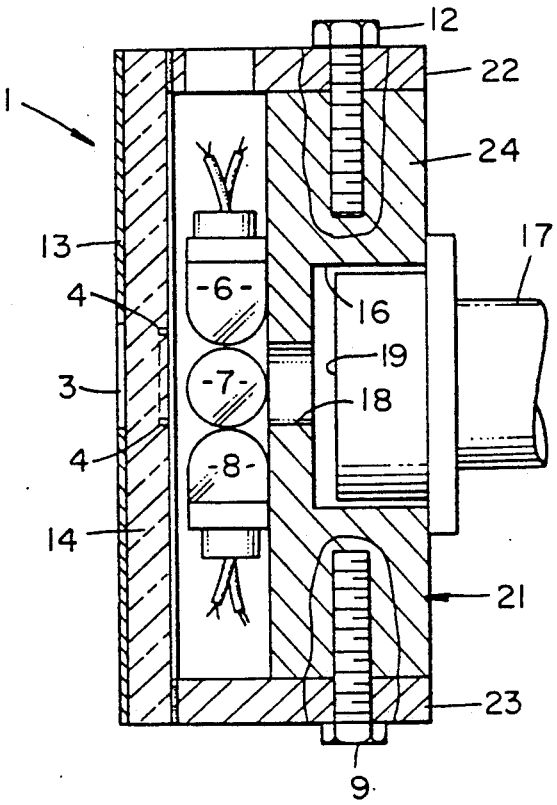

COMBINED LASER POSITION DETECTOR, INFRARED EMISSIVITY TARGET AND TV TARGET

BACKGROUND OF THE INVENTION

1. Field of the Invention

This invention relates to a combined laser position detector, infrared emissivity target and TV target combined in a single, small rugged unit for use in testing electro-optical systems.

2. Description of Related Art

Until now, systems for testing and for measuring the misalignment of the optical lines of sight of forward looking infrared, television, and laser systems have included a plurality of target projectors and laser optical detectors. A need has arisen for a small, compact, rugged unit that incorporates infrared and TV targets as well as a laser position detector for measuring misalignment of forward-looking infrared, television, and laser optical lines of sight.

SUMMARY OF THE INVENTION

A combined laser position detector, infrared emissivity target and TV target includes a light-transparent substrate with an opaque coating forming an optical TV target on one side, and an infrared emissivity target on an opposite side. The infrared target and the TV target are in registration with one another, such that light passing through one of the targets also passes through the other. The coated substrate is affixed to a housing means that includes light-emitting means behind the TV target side of the coated substrate, positioned to direct emitted visible light through the television target and the infrared target. The housing means is adapted to receive laser position detector means behind the light-emitting means, with the detector means positioned for impingement on the detector means of light passing through the TV target and the infrared target.

In preferred embodiments, the substrate comprises the front wall of the housing. In such embodiments, the housing includes a rear wall having a recess adapted to receive laser position detector means. The recess has, on its inner wall, an opening that is positioned behind, and in registration with the emissivity infrared target and the light-opaque television target.

In preferred embodiments, the light-transparent substrate comprises a glass panel with a light-opaque coating over one side, except for the area forming an infrared target of desired size and shape. The opposite side of the substrate includes an area etched to form the television target. In preferred embodiments, the emissivity infrared target overlies, and is in registration with a substantial portion of the TV target.

BRIEF DESCRIPTION OF THE DRAWINGS

The invention can better be understood by reference to the drawings, in which:

FIG. 1 provides a front elevational view of a preferred embodiment of the combined laser position detector, infrared emissivity target and TV target;

FIG. 2 is a perspective view of the coated substrate that forms part of the combined laser position detector, infrared emissivity target and TV target embodiment shown in FIG. 1;

FIG. 3 is a side elevation view in cross-section, taken on lines 3—3, of FIG. 1, and shows the housing for the embodiment depicted in FIG. 1, the light-emitting elements in this embodiment, and the laser position detector;

FIG. 4 is a side elevation view in cross-section taken on line 4—4 of FIG. 2, and showing in detail the television target and emissivity infrared target formed on the substrate;

DESCRIPTION OF THE PREFERRED EMBODIMENTS

Figure 6:
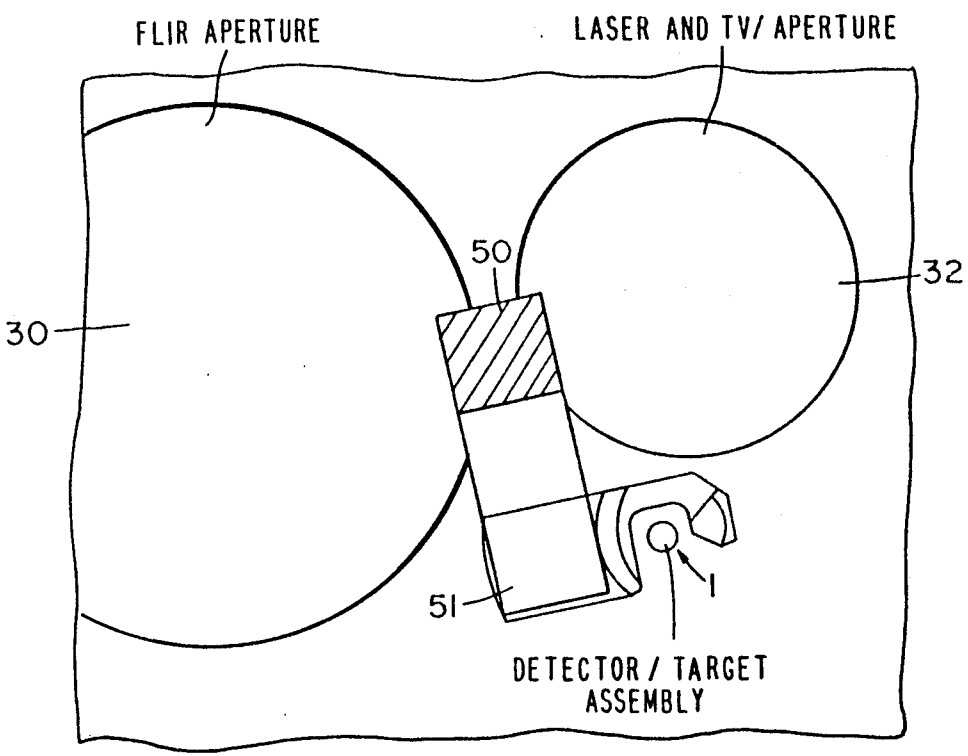
FIG. 6 is a front elevation view of the boresight shown in FIG. 5.

FIGS. 1, 2 and 4 show a preferred embodiment of the combined laser position detector infrared emissivity target, and TV target generally designated 1. FIGS. 2 and 4 show glass substrate 14 and target patterns 3 and 4. The combined detector 1 includes substrate 14 having light-opaque coating 13 and having an emissivity infrared target 3 in the shape of a square at the center on a first side of substrate 14 where light-opaque coating 13 is absent, and a smaller light-opaque TV target 4 which is a square line formed by etching substrate glass 14 on the side opposite coating 13, and filling the line with a light opaque material. FIG. 4 is a side view of the glass substrate illustrating the infrared target 3 on one side of the glass, and etched TV target 4, consisting of a square line filled with an opaque material, on the other side of the glass.

The light-opaque coating on substrate 14 is typically chrome oxide, and the substrate 14 is commercially available with the chrome oxide coating already applied. Because the substrate is readily available with the chrome oxide coating applied, the most convenient way to form target 3 is merely to remove a rectangular area of the chrome oxide. This forms the clear rectangular area referred to as emissivity target 3. As shown in FIGS. 2, 3 and 4, TV target 4 is formed on the opposite side of substrate 14 from emissivity target 3. TV target 4 is formed by etching a rectangular trough, i.e., the trough or groove 40 circumscribes a rectangular area. The groove 40 may typically be 0.02 inch wide and extend about 0.002 inch deep into the glass substrate 14 which is on the order of 0.06 inch thick. When the rectangular groove 40 has been completely etched, it is then filled with a substance such as sodium silicate and titanium dioxide to form the rectangular solid line of target 4. The rectangular area inside target 4 is clear. Target 3 may measure about 0.2 inch on a side and target 4 could be 0.12 inch on a side to fit easily within target 3. These dimensions and shapes are illustrative only, and other dimensions and shapes may be desired depending upon the specific application.

In FIG. 1, light-emitting lamps 5, 6, 7 and 8 are shown in outline because they are positioned behind substrate 14 so as to permit the light they emit to pass through glass subtrate 14 and be obstructed by both the emissivity target 3 and TV target 4. Also shown in outline are screws 9, 10, 11 and 12, which hold the back panel 24 of housing 21 to the side panels 22 and 23 (see FIG. 3). In some embodiments, the usually smaller TV target 4 is not required when the size of the IR and TV target can be made equal. Then, target 3 functions both as an infrared and as a TV target.

FIG. 3 shows the construction of an arrangement of the laser position detector 17, and target 1 that includes infrared target 3 and TV target 4. Housing 21 includes top panel 22, bottom panel 23, glass substrate 14 with light-opaque coating 13 thereon, and rear panel 24. Rear panel 24 includes recess 16 that is adapted to receive laser position detector 17 and to fix its position in relation to the positions of TV target 4 and emissivity target 3. The readout from detector 17 is electrically calibrated to measure misalignment of the laser relative to TV target 4 and infrared emissivity target 3. On the inner wall of recess 16 is opening 18 through which laser light can pass to strike the front surface 19 of laser position detector 17. Lamps 5, 6, 7 and 8 provide illumination necessary for TV target 4 and sufficient energy to heat infared target 3. Screws 9, 10, 11 and 12 hold rear panel 24 to top and bottom walls 22 and 23 of housing 21.

Figure 5:
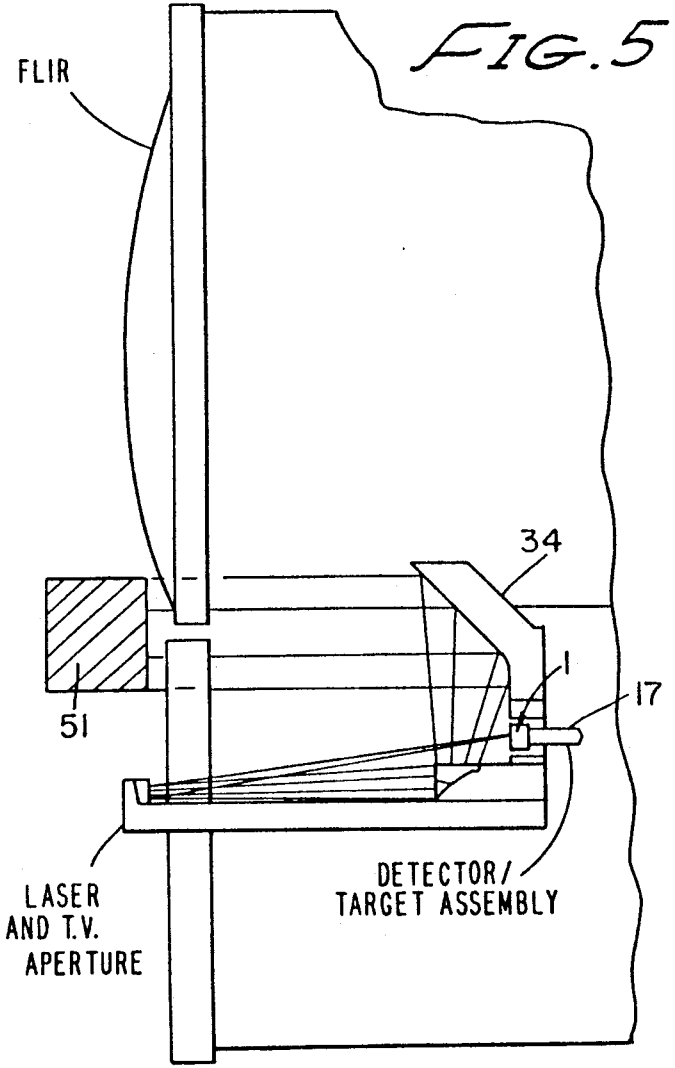
FIG. 5 is a side elevation view of a weapon system incorporating a forward-looking infrared receiver (FLIR), a laser, a television system, and an optical test system for measuring the optical alignment, or boresight, of three optical systems while they are being flown in an aircraft.

FIGS. 5 and 6 show an optical system that incorporates a FLIR, TV, and laser with an optical collimator consisting of mirrors 50 and 51 to collect or transmit a portion of optical energy from two apertures 30 and 32. These energies are focused by optical collimator 34 onto combined TV/infrared targets and laser position detector 1 shown in FIGS. 1-4.

Generally, the FLIR optical component and the laser/TV optical component are separate assemblies which should be mounted within a common chassis with their optical centerlines (boresights) precisely aligned. The target of the present invention is used to check such alignment. To check the alignment of the FLIR, emissivity target 3 is activated (i.e., heated by lamps 5, 6, 7 and 8). The emitted IR energy travels from the target 3, through collimator 34, through the periscope (mirrors 50 and 51) and enters the FLIR aperture 30 and the FLIR optical system (not shown). At this point, automatic electronic FLIR tracking devices (not shown) measure the position of the emissivity target within the FLIR field of view. The target should be centered for proper FLIR alignment. If not centered, the mechanical mountings of the FLIR are adjusted to bring the image of target 3 into proper alignment.

To check the alignment of the TV optics, TV target 4 is actived (i.e., lamps 5, 6, 7 and 8 are turned on to illuminate target 4). The image of target 4 is similarly projected through collimator 34, reflected off mirrors 50 and 51, and enters the TV/laser aperture 32, and the TV optical system (not shown). Again, automatic electronic tracking devices measure the position of the projected TV target 4 within the TV optics field of view. If the TV target is not centered, the mechanical mountings of the TV optical assembly are adjusted to bring the image of TV target 4 into proper position.

To check the alignment of the laser optical system, a laser (not shown) is fired. Laser energy exits the laser/TV aperture, is reflected off mirrors 50 and 51 into collimator 34, and is focused through target 3 and target 4 onto the forward surface 19 of laser detector 17. Again, automatic electronic equipment then measures the position of the laser beam and determines alignment. If the laser beam center is not aligned, adjustments are made via the laser optics mounting devices. Thus, all three optical systems can be properly aligned, utilizing the rugged, combined target system described herein.

In some embodiments, the TV and infrared targets can be substantially the same size. In such embodiments, both the TV and infrared targets comprise an uncoated target formed by removing a portion of the coating from a substrate such as a glass substrate. In the embodiment of FIGS. 5 and 6, infrared target 3 in FIGS. 1 and 2 is larger than TV target 4 in FIGS. 1 and 2. Thus, the TV target is etched on the opposite side of the glass substrate from the infrared target. Preferably, both targets are on the first side of substrate 14, which results in increased optical accuracy.

In military applications, shock and vibration can cause optical misalignment of plural target projectors to occur. The test equipment measuring these misalignments must be rugged, and resistant to change. This invention incorporates a plurality of targets or sensors into a single unit that resists misalignment from shock and vibration. By contrast, units including a plurality of separately-made, optically-combined targets (i.e., plural target projectors) and sensors in a system incorporating mirrors and/or beam splitters is difficult to align and to maintain in alignment.

What is claimed is:

1. A combined laser position detector, infrared target and TV target comprising:

housing means;

a light transparent substrate having an infrared target on a first side of said substrate and a TV target on an opposing second side of said substrate, said TV target and said infrared target being in registration with one another, said substrate being affixed to said housing means;

light-emitting means in said housing and behind said substrate for directing emitted light through said TV target and through said infrared target and for heating said infrared target; and laser position detector means positioned behind said light-emitting means and in alignment with said TV target and infrared target for receiving laser light passing through said TV target and through said infrared target.

2. The device of claim 1 wherein said substrate comprises the front wall of said housing, and said housing includes a rear wall having a recess for receiving said laser position detector, said recess having an opening on its inner wall, said opening being behind and in registration with said infrared target and said television target.

3. The device of claim 1 wherein said substrate comprises a glass panel with a light-opaque coating on said first side, said coating having an opening therein forming an infrared target of desired size and shape.

4. The device of claim 1 wherein said TV target comprises an etched area of desired size and shape on said second side, and said infrared target comprises an uncoated area of desired size and shape on said first side overlying, and in registration with said etched area.

5. A combined laser position detector, infrared emissivity target and TV target for determining the optical alignment of infrared, laser, and TV systems comprising;

housing means;

a light transparent substrate having a light opaque coating disposed on a first side of said substrate and a target area disposed on the first side and surrounded by said coating, said target area having a shape and size for functioning as both a TV target and an infrared target, said substrate being affixed to said housing means;

light emitting means disposed in said housing and positioned behind said substrate for directing emitted light through said target area and for heating said target area to determine alignment of the TV and infrared systems;

laser position detector means disposed in said housing in alignment with said target area and positioned behind said light emitting means for receiving laser energy to determine alignment of the laser system.

6. The detector of claim 5 wherein said substrate comprises the front wall of said housing, and said housing includes a rear wall having a recess for receiving said laser position detector to fix its position relative to said target area, said recess having an opening on its inner wall behind and in alignment with said target area.

* * * * *